US012710251B2

(12) United States Patent
Spuhr

(10) Patent No.: US 12,710,251 B2
(45) Date of Patent: Aug. 18, 2026

(54) SIGHT AND ACCESSORY MOUNT ASSEMBLY FOR A FIREARM

(71) Applicant: Spuhr i Dalby AB, Löddeköpinge (SE)

(72) Inventor: Håkan Spuhr, Dalby (SE)

(73) Assignee: Spuhr i Dalby AB, Löddeköpinge (SE)

( * ) Notice: Subject to any disclaimer, the term of this patent is extended or adjusted under 35 U.S.C. 154(b) by 57 days.

(21) Appl. No.: 18/652,228

(22) Filed: May 1, 2024

(65) Prior Publication Data

US 2024/0369325 A1 Nov. 7, 2024

(30) Foreign Application Priority Data

May 2, 2023 (EP) ..... 23171198

(51) Int. Cl.
*F41G 11/00* (2006.01)

(52) U.S. Cl.
CPC ..... *F41G 11/003* (2013.01); *F41G 11/007* (2013.01)

(58) Field of Classification Search
CPC ..... F41G 11/003; F41G 11/007
See application file for complete search history.

(56) References Cited

U.S. PATENT DOCUMENTS 944,916 A * 12/1909 Shepard ..... G02B 23/14 356/247
2,629,175 A * 2/1953 Merritt ..... F41G 11/008 42/128
3,226,868 A * 1/1966 Mahoney ..... F41G 11/008 42/128
6,637,144 B2 * 10/2003 Nelson ..... F41G 11/003 42/120
7,908,782 B1 * 3/2011 LaRue ..... F41G 11/008 42/124
8,424,234 B2 * 4/2013 Carlson ..... F41G 11/001 42/90
8,935,875 B2 * 1/2015 Collin ..... F41G 11/003 42/124
9,163,902 B1 10/2015 Cheng et al.
9,217,621 B2 * 12/2015 He ..... F41G 1/387
9,417,034 B1 * 8/2016 Swan ..... F41G 1/17
10,162,168 B2 * 12/2018 Teetzel ..... A42B 3/042
10,634,456 B1 * 4/2020 Fischer ..... F41G 11/003
(Continued)

FOREIGN PATENT DOCUMENTS

DE 202018101992 U1 4/2018

*Primary Examiner* — Michelle Clement
(74) *Attorney, Agent, or Firm* — Shore IP Group, PLLC; Howard J. Klein

(57) ABSTRACT

A sight and accessory mount assembly for a firearm having a rail includes a sight mount configured to carry a sight, and an accessory mount configured to carry an accessory. The accessory mount extends rearwardly from, and is pivotally connected to, the sight mount when the sight and accessory mount is attached to the firearm rail. The accessory mount is rotatable between a first end position and a second end position relative to the first sight mount, wherein in the first end position the accessory mount and an accessory that may be carried by the accessory mount are aligned with the sight mount and a sight that may be carried by the sight mount, and in the second end position the accessory mount and an accessory that may be carried by the accessory mount are pivoted away from the sight mount.

20 Claims, 6 Drawing Sheets

(56) References Cited

U.S. PATENT DOCUMENTS

| | | | | |
|---|---|---|---|---|
| 10,989,499 | B2 * | 4/2021 | Connolly | F41G 11/008 |
| 11,906,269 | B2 * | 2/2024 | Lin | F41G 11/001 |
| 12,000,673 | B2 * | 6/2024 | Zimmer | F41G 11/007 |
| 12,025,407 | B2 * | 7/2024 | Itshaky | F41G 11/008 |
| 12,050,083 | B2 * | 7/2024 | Zimmer | F41G 11/007 |
| 12,135,190 | B2 * | 11/2024 | Zimmer | F41G 11/003 |
| 12,287,178 | B2 * | 4/2025 | Zimmer | F41G 11/007 |
| 2011/0296732 | A1 * | 12/2011 | Carlson | F41G 11/008 42/90 |
| 2013/0008072 | A1 * | 1/2013 | Chung | F41G 1/30 42/113 |
| 2014/0123532 | A1 * | 5/2014 | Russ | F41G 1/38 42/113 |
| 2021/0223000 | A1 * | 7/2021 | Donahue | F41G 1/14 |
| 2021/0348887 | A1 * | 11/2021 | Connolly | F41G 11/008 |

* cited by examiner

SIGHT AND ACCESSORY MOUNT ASSEMBLY FOR A FIREARM

CROSS-REFERENCE TO RELATED APPLICATION

This application claims priority from European Application No. 23171198.7, filed May 2, 2023, the disclosure of which is incorporated herein by reference in its entirety.

BACKGROUND

The proposed technology disclosed herein relates generally to the field of sighting systems for firearms. The disclosed technology relates specifically to the field of sight and accessory mounts for firearms, particularly rifles and machine guns.

Single sight mounts and dual-sight mounts for firearms are known. Dual-sight mounts allow for quick transition from a first sight to a second sight. The first sight can be used for long-range engagements and the second sight may be used for close-range engagements. The first sight and the second sight can be optically aligned such that target acquisition can be performed by an operator viewing through both sights. It is also known to combine different types of optical components on a dual-sight mount, for example a sight and an optical accessory, such as an image intensifier.

The dual-sight mount can be fixed or selectable. The fixed dual-sight mount allows for no articulation of the optical components relative to the firearm. Tooling is typically required to remove one of the optical components. Selectable dual-sight mounts typically allow one of the optical components to shift in position relative to the firearm such that one of the optical components can be used independently from the other. For example, the selectable dual-sight mount may fix a sight relative to the firearm and allow an optical accessory, such as an image intensifier, to be folded into or away from the sightline of the sight.

A dual-sight mount is typically significantly heavier than a single-sight mount. Additionally, a selectable dual-sight mount typically has an articulated mechanism that makes it heavier than a fixed dual-sight mount. The added weight may be a disadvantage under prolonged field conditions and when operating the firearm. The articulated mechanism may not be silent when used, thus risking an operator to reveal himself. The articulated mechanism may also have play relative to the firearm or between the optical components, which can cause noise and result in decreased accuracy and precision when shooting.

SUMMARY

The disclosed technology aims at obviating the aforementioned disadvantages and failings of previously known technologies. It is an object of the disclosed technology to provide a selectable dual-sight mount assembly, or sight and accessory mount assembly, for a firearm, wherein the assembly has a low weight. It is a further object to provide a selectable sight and accessory mount assembly that is silent in use. It is a further object to provide a selectable sight and accessory mount assembly with minimized effect on accuracy and precision when using the firearm. It is a further object to provide a selectable dual-sight mount assembly or sight and accessory mount assembly that has a small footprint on a firearm. It is a further object to provide a quick and secure releasable connection of an accessory to a sight.

In a first aspect of the proposed technology disclosed herein, a sight and accessory mount for a firearm comprises: a sight mount configured or arranged to carry (as by being fastened or fixed to) a sight, wherein the sight mount is arranged or configured to be attached or fixed to the firearm at least partly between the sight and the firearm; an accessory mount arranged or configured to carry (as by being fastened or fixed to) a firearm accessory, wherein the accessory mount is pivotably or pivotally connected or attached to the sight mount, and wherein the accessory mount extends from the sight mount in a direction aligned with the firearm, wherein the accessory mount has a first end position and a second end position relative to the sight mount between which it can pivot, wherein in the first end position the firearm accessory is aligned with the sight, and in the second end position the firearm accessory is pivoted away from the sight.

The fact that the accessory mount is pivotably or pivotally connected to the sight mount and extends in a direction aligned with the firearm means that it does require any attachments between the accessory mount and the firearm, which contributes to a lower weight and a smaller footprint compared to other common sight and accessory mounts. It is specified that the accessory mount extends from the sight mount in a direction aligned with the firearm. For example, this may be relative to the barrel of the firearm, or in a rearward direction or a forward direction relative to the firearm. Preferably, the accessory mount extends in the rearward direction. The sight and accessory mount assembly may have a pivot axis around which the accessory mount can pivot relative to the sight mount.

The firearm may have a rail, and the sight mount may be arranged or configured to be attached or fixed to the rail. The sight mount would then be positioned between, or at least partly between, the sight and the rail. For example, the rail may be a Picatinny rail, or a MIL-STD-1913 rail or, a STANAG 4694 rail.

The sight may be an optical sight, such as a red dot sight, a reflex sight or reflector sight, a holographic sight, or a telescopic sight or scope. It is understood that a firearm accessory may be an image intensifier or magnifier, or a magnifying optic accessory.

The sight may be an optical component, and the accessory may also be an optical component. The two optical components may define a common optical axis when aligned with each other, the common optical axis being defined as an imaginary line that defines the path along which light propagates through both optical components from a target to the eye of an operator when sighting.

The sight mount may have a rear side, or first side, a front side, or second side, a right side, or third side, and a left side, or fourth side. The rear side and the front side, or first side and second side, are opposite, and the right side and the left side, or third side and fourth side, are opposite. The accessory mount may extend from the rear side or the front side, preferably the former.

Here, the terms rear side and rear are understood to be from the perspective, or relative, to a shooter operating the firearm, which means that the rear side faces, and is closer to, the shooter than the front side of the sight mount. Thus, as understood, the front side faces in a firing direction of the firearm, that is, the front side faces a target. The right side may be formed by a right side wall, and the left side may be formed by a left side wall. In addition, the sight mount may have a lower side adapted to be attached to, or mate with, the firearm or the rail of the firearm.

The sight mount may further have an upper side. The sight mount, or the upper side, may have or form a first attachment for a sight. The first attachment may be a rail, such as a Picatinny rail, or a ring mount.

It is understood that the sight mount may be releasably attached to the firearm rail. For example, the sight mount may be clamped to the firearm, or to the rail of the firearm.

It is specified above that that the accessory mount may extend from the sight mount in a rearward direction relative to the firearm. It is understood that when the sight and accessory mount assembly is attached to a firearm, or a rail of a firearm, and carries a sight and an accessory, the accessory and the accessory mount are closer to the shooter than the sight and the sight mount. The sight mount may thus be mounted to a firearm having the rear, or first side, facing the operator of the firearm.

The sight mount may be a monolithic body or structure. The sight mount may outline a cube or cuboid.

The sight mount may be of aluminum. The sight mount may, for example, be milled from an aluminum blank. Alternatively, the sight mount may be cast and subsequently milled. The aluminum may be aluminum 7055 or 7075.

The sight mount may have or form one or more cuts or recesses that reduce the weight of the sight and accessory mount assembly. The cuts may be through-going, and they may extend from the rear side to the front side, and/or from the right side to the left side. Worded differently, the sight mount may be topologically optimized with respect to structural strength. For example, this may be achieved through simulation and milling of the sight mount to reduce the weight of the sight mount and to a predetermined structural strength.

The accessory mount may be releasably attached to the sight mount. This allows the sight mount to be used on its own, which contributes to the flexibility in the use of the proposed technology.

The accessory mount may have a rear side, or first side, and a front side, or second side. It is understood that the rear side and the front side are opposite. The front side of the accessory mount may face the rear side of the sight mount. Worded differently, the rear sides of the sight mount and the accessory mount may face in the same direction. Similarly, the front sides of the sight mount and the front side of the accessory mount may face in the same direction.

The accessory holder may span an angle in the range of 60-90 degrees, or of 30-180 degrees, at a transition from the first end position to the second end position. Worded differently, the angle between the accessory mount in the first end position and the accessory mount in the second end position relative to the pivot axis may be in the range of 60-90 degrees, or 30-180 degrees. These ranges or spans or exemplary only, and other ranges or spans may be selected according to operational considerations.

The front side of the accessory mount may form a protrusion that extends in a direction along the firearm, preferably in a forward direction, or along the pivot axis, as further discussed below. The protrusion may overlap the right side or the left side, or at least a portion of a portion the right side or the left side, of the sight mount. The overlapping is understood to be along the firearm, the rail of the firearm, or the pivot axis described below.

The protrusion may engage the right side or the right side wall in the first end position and in the second end position of the sight mount. This means that the first end position and the second end position may be defined by the protrusion engaging the right side or the right side wall of the sight mount. The right side or right side wall of the sight mount may form a first end stop and a second end stop that engage the protrusion. The first and second end stops may be reinforced. The preferred arrangement of the protrusion is described above. Alternatively, it may be arranged in the same manner with respect to the left side or the left side wall.

The protrusion may be arranged to limit a rotation of the accessory mount relative to the sight mount around the pivot axis to an angle in the range of 60-90 degrees, 30-180 degrees, or any other desired range. This contributes to a compact sight and accessory mount assembly.

The protrusion may form a wall, for example outlining a sector of a cylinder centered on the pivot axis. The wall may have a first wall end and a second wall end. The wall extends between the first wall end and the second wall end. The first wall end may engage the sight mount in the first end position of the accessory mount and the second wall end may engage the sight mount in the second end position of the accessory mount. Preferably, the first wall end and the second wall end engage the right side or right side wall of the sight mount.

The sector of the cylinder, or the first end and the second end of the wall, may span an angle in the range of 60-90 degrees, 30-180 degrees, or any other desired range, relative to the pivot axis. Worded differently, the sector of the cylinder may span between a $1/6$ to $1/4$, $1/12$ to $1/2$, or any other partial segment of a full circle. In one example, the angle is 80 degrees, which results in the first and second end positions being separated by 80 degrees of pivoting movement.

The protrusion and the accessory mount may form a monolithic structure. This means that the accessory mount with the protrusion may be machined from a single workpiece blank, for example by milling. In one alternative, the protrusion is a separate component that is attached to a front side of the accessory mount.

The accessory mount may further have or form a second attachment for the accessory. The second attachment may be a rail, such as a Picatinny rail, or a ring mount.

As specified above, the accessory mount is pivotably or pivotally connected to the sight mount, and the accessory mount has a first end position and a second end position relative to the sight mount between which it can pivot. In the first end position, the accessory is aligned with the sight, and in the second end position the accessory is pivoted away from the sight. The sight and accessory mount may be arranged to pivot the accessory mount downward and sideways relative to the sight, or relative to the pivot axis, at a transition from the first end position to the second end position. In the second end position, the second optical component may clear the sight. This means that in the second end position, the accessory does not obstruct the sight or the sight picture provided by the sight. The sight may thereby be used without the accessory interfering.

In the first end position, the accessory is aligned with the sight. Worded differently, in the first end position the accessory may be collinear with the sight. This means that the optical axis of the sight and the optical axis of the accessory are aligned and overlap. The sight and the accessory may then be used simultaneously. As specified above, the sight mount may have a lower side, and in the second end position, at least a portion of the accessory mount may be pivoted to intersect a plane defined by the lower side of the sight mount. Worded differently, in the second end position, a portion of the accessory mount may be arranged to be located at the rail of the firearm, or in the second end position the accessory mount may be arranged to contact the firearm or the rail of the firearm. The accessory mount may be spaced apart from, or have a clearance with respect to, the firearm or the rail of the firearm in the second end position.

The sight and accessory mount assembly may then be arranged to elastically deform and contact the firearm or the rail of the firearm, at a force acting to set the accessory mount in the second end position. The force may be in the range of, for example, 10 to 80 N, or 20 to 40 N. The features described here allow for forces acting on the accessory mount or accessory, for example when dropping the firearm, to be transferred to the firearm. This may reduce the risk of damage to the accessory mount or the accessory.

It is specified above that the accessory mount may extend from the rear side or the front side, preferably the former. This means that the accessory mount may extend outwards over the rail when the sight and accessory mount is attached to the rail of the firearm. Worded differently, the accessory mount may protrude from the sight mount, and the accessory mount may define an overhang over the firearm or the rail of a firearm. This contributes to a sight and accessory mount that has a shorter base, or smaller footprint, in addition to the abovementioned lower weight.

In one alternative, the sight mount has a first length along, or parallel with, the firearm or the rail of the firearm. Similarly, the accessory mount has a second length along, or parallel with, the firearm or the rail of the firearm. The sight and accessory mount assembly may have a total length along, or parallel with, the firearm or the rail of the firearm. It is understood that the total length encompasses both the sight mount and the accessory mount. The first length may, for example, be 40-60% of the total length of the sight and accessory mount assembly. This means that the length of the contact between the sight and accessory mount assembly and the rail is not more than 40-60% of the total length of the sight and accessory mount assembly. This may contribute to the reduction of the footprint and/or the weight of the sight and accessory mount assembly.

The accessory mount may form or comprise a pivot pin or spigot, and the sight mount may form or comprise a recess or hole, wherein the pivot pin is received in or mated with the recess, and the pivot pin and the recess cooperate to pivotally connect the accessory mount to the sight mount. Worded differently, the pivot pin and the recess cooperate to form a pivot connection between the sight mount and the accessory mount. The pivot pin may form part of the abovementioned monolithic structure of the accessory mount. Alternatively, the pivot pin is a separate component, for example of steel, such as stainless steel.

The pivot pin may be fixed or securely fastened to the accessory mount, for example by a transverse fixing screw, a press fit mount, or cooperating threads. The pivot pin may be centered on the pivot axis. This means that the pivot pin rotates around the pivot axis at a transition from the first end position to the second end position of the accessory mount.

It is specified above that the sight mount has a right side and a left side. The pivot axis may be arranged at the right side, or third side, or right side wall, of the sight mount. This means that the protrusion is located beside the right side wall of the sight mount.

The protrusion may overlap the right side wall of the sight mount and be arranged to limit the accessory mount to pivot downward in a first rotational direction away from the sight. Alternatively, the protrusion may be arranged to limit the accessory mount to pivot upward and outward in a second rotational direction away from the sight. It is understood that the first rotational direction is opposite to the second rotational direction. This means that the accessory mount pivots upward, away from the sight, to a position at a right side of the sight mount.

The pivot axis may be arranged at the left side, or fourth side, or left side wall, of the sight mount. This means that the protrusion is located beside the left side wall of the sight mount. The protrusion overlaps the left side wall of the sight mount and may be arranged to limit the accessory mount to pivot downward in a second rotational direction away from the sight. Alternatively, the protrusion may be arranged to limit the accessory mount to pivot outward and downward in the first rotational direction away from the sight. This means that the accessory mount pivots outward and downward, away from the sight, to a position at the left side of the sight.

In the first end position of the accessory mount, the pivot pin or pivot axis may be located below the accessory. In the first end position of the accessory mount, the pivot pin or pivot axis may be located at the right side of the sight mount. This contributes to a sight and accessory mount assembly that has a small footprint on a firearm.

It is specified above that the sight mount has a right side and a left side. The pivot axis may be located either at the right side or at the left side. The accessory mount may be connected to the sight mount at a right or left side wall of the sight mount. Worded differently, the pivot axis may be arranged offset from an imaginary center axis of the sight mount, the center axis extending between the upper and lower side of the sight mount. The pivot axis may be parallel with a bore axis of the firearm. The pivot axis being offset provides a compact pivot mechanism. The pivot axis may be parallel to the rail of the firearm and/or to the optical axis of the sight.

It is specified above that the accessory may be an optical component having an optical axis. In the first position of the accessory mount, the optical axis of the accessory may be above the pivot pin or the pivot axis. In the second position of the accessory mount, the optical axis of the accessory may be below the pivot pin or pivot axis.

It is specified above that the sight mount has an upper side and a lower side. The pivot axis may be located below the upper side of the sight mount, and above the lower side of the sight mount. This means that the pivot axis is located between the upper side and the lower side of the sight mount. Worded differently, the protrusion overlaps or forms a portion of the side wall of the sight mount. In this configuration, the accessory mount may only pivot downward and not outward. Worded differently, the accessory mount being connected to the sight mount at a position located at the right side wall means that the connection is arranged closer to the right side wall than to the left side wall. The pivot axis is thereby offset closer to the right side wall.

The sight and accessory mount assembly may include a cross bolt slidably supported in a through hole extending from the left side of the sight mount to the right side of the sight mount. The through hole may have a diameter closely matching the diameter of the cross bolt, with sufficient clearance to allow the cross bolt to slide axially therein. Thus, the through hole guides and supports the radial surfaces of the cross bolt and permits the cross bolt to slide along an axis of the cross bolt to transition between a first position and a second position within the through hole. In the first position, the cross bolt engages the pivot pin and prevents the pivot pin from moving in an axial direction relative to the pivot axis. The pivot pin may have a recess, and the cross bolt may engage the recess in the first position. The recess of the pivot pin may be an annular recess, such as an annular groove, preferably located at or near the tip of the pivot pin. In the second position, the cross bolt may disengage from the recess or groove of the pivot pin, so as to allow the pivot pin to move in the axial direction. Worded differently, in the first position, the cross bolt engages the recess of the pivot pin and locks the pivot pin in the axial direction. The crossbolt may be manufactured of steel, such as stainless steel.

The cross bolt may form or comprise a recess or cutout that matches or corresponds to the recess of the pivot pin. The recess of the cross bolt may be an annular recess. The cross bolt may be rotationally symmetric, and the pivot pin may also be rotationally symmetric. This has the effect that the rotational alignment of the cross bolt and the pivot pin does not affect the interaction between the two. In addition, both recesses (i.e., the cross bolt recess and the pivot pin recess) being annular recesses may contribute to a lighter weight sight and accessory mount assembly, particularly if these components are manufactured of steel.

In the first position, the recess of the pivot pin may be misaligned or not aligned with the recess of the cross bolt, and thereby prevents the movement of the pivot pin in the axial direction. In the second position, the recess of the pivot pin is aligned with the recess of the cross bolt, and the pivot pin can move in the axial direction independently from the crossbolt. The cross bolt and pivot pin thus allow for the second sight mount to be removed in a simple manner. This contributes to a quick and secure releasable connection of an accessory to a sight. Thereby, the sight mount can be used alone, without the accessory mount being mounted to the sight mount.

The recess of the sight mount receiving the pivot pin and the through hole may be connected. Worded differently, the recess of the sight mount and the through hole of the cross bolt may intersect or be interconnected. The through hole may be arranged transverse to the pivot pin or pivot axis.

The sight mount may comprise a spring loaded first plunger arranged to releasably lock the cross bolt in either the first position and in the second position. The sight mount may form or comprise a first blind hole or first plunger hole, and the first plunger may be arranged in the first plunger hole. The first plunger may be configured aa a cylinder with a hemispherical or rounded end that engages the cross bolt. Alternatively, the first plunger may be spherical. The first plunger may be of steel, such as stainless steel. This is advantageous in combination with the cross bolt being of steel.

The first blind hole or first plunger hole may intersect the through hole. This means that the through hole and the first plunger hole are connected or joined. The through hole may have a first axis and the first plunger hole may have a second axis, with the first and second axes crossing or intersecting.

The cross bolt may form or comprise a first cross bolt recess and a second cross bolt recess. The first plunger may engage or cooperate with the first cross bolt recess in the first position of the crossbolt and engage or cooperate with the second cross bolt recess in the second position of the of the cross bolt. The cross bolt may further form or comprise a cross bolt ridge positioned between, or separating, the first cross bolt recess and the second cross bolt recess. The first cross bolt recess, the second cross bolt recess, and the cross bolt ridge may be annular. The first plunger may continuously engage the cross-bolt at a transition from the first position to the second position, and vice versa. The first cross bolt recess engaging the first plunger may define a first end position of the cross bolt. The second cross bolt recess engaging the first plunger may define a second end position of the cross bolt. When the cross bolt transitions from the first position to the second position, the first plunger moves from the first cross bolt recess, over the cross bolt ridge, to the second cross bolt recess. This way, when the first plunger passes over the cross bolt ridge, a distinct tactile feedback is given to the operator that the accessory mount has been locked to, or unlocked from, the sight mount. The first plunger, or the first plunger hole, may be arranged transverse to the cross bolt, or the through hole, and inclined relative to the lower side of the sight mount.

The sight and accessory mount assembly may comprise a pivot lock arranged to releasably lock the accessory mount in the first end position relative to the sight mount. The pivot lock may further be arranged to releasably lock the accessory mount in the second end position relative to the sight mount. The pivot lock may comprise a spring-loaded second plunger. The accessory mount may comprise or form a first indentation and a second indentation. The second plunger may cooperate with the first indentation and bias the accessory mount towards the first end position. The second plunger may cooperate with the second indentation and bias the accessory mount towards the second end position. The second plunger may continuously engage the accessory mount at a transition from the first end position to the second end position of the accessory mount, and vice versa. The accessory mount may form a smooth surface between the first indentation and the second indentation, and the second plunger may engage the smooth surface at a transition of the accessory mount from the first end position to the second end position, and vice versa.

The second plunger may be arranged in a second blind hole or second plunger hole in the sight mount. The second plunger may be a sphere that is engageable with the first indentation and the second indentation, or it may be cylindrical with a hemispherical end or head that is engageable with the first indentation and the second indentation. The second plunger may be of steel, such as stainless steel. In either case, the first indentation and the second indentation form first and second seats, respectively, with which the second plunger is engageable.

The first indentation and the second indentation may, at least partly, match the shape of the second plunger. To disengage the pivot lock to pivot the accessory mount, the spring force acting on the second plunger pressed against the indentation must be overcome. The pivot lock may thus be referred to as a biasing pivot lock.

The sight and accessory mount assembly, or the pivot lock, may comprise an insert that forms the first indentation and/or the second indentation. The insert may be a separate component or structural part from the second sight holder. It may be annular and form a through hole, and the pivot pin may extend through the through hole.

The accessory mount may form or comprise a seat matching the insert. The seat may be rotationally asymmetric relative to the pivot axis, and the insert may outline an asymmetric shape matching the seat. This has the effect that the insert rotates with the accessory mount. Worded differently, the insert is prevented from rotating relative to the accessory mount. The insert may form a protrusion extending radially relative to the pivot axis, or the pivot pin. The protrusion engages a matching recess or opening of the seat of the accessory mount. By arranging the indentations on a separate structural insert, the material of the member may be different from the second sight mount.

It is specified above that the second plunger may be of steel. The insert may also be of steel, such as stainless steel. This reduces wear on the second plunger and the insert and increases the mechanical life of the mechanism. In addition, the second plunger and the insert may be replaced at a lower cost compared to replacing the complete accessory mount and/or the sight mount.

A second aspect of the proposed technology disclosed herein is a sight and accessory system comprising a sight and accessory mount assembly of the first aspect, a sight carried by, or fastened to, the sight mount, and a firearm accessory carried by, or fastened to, the accessory mount.

A third aspect of the proposed technology disclosed herein is a firearm to which is mounted or attached a sight and accessory and accessory system of the second aspect.

BRIEF DESCRIPTION OF THE DRAWINGS

A more complete understanding of the abovementioned and other features and advantages of the proposed technology disclosed herein will be apparent from the following detailed description of preferred embodiments in conjunction with the appended drawings, wherein.

DETAILED DESCRIPTION

Figure 1:
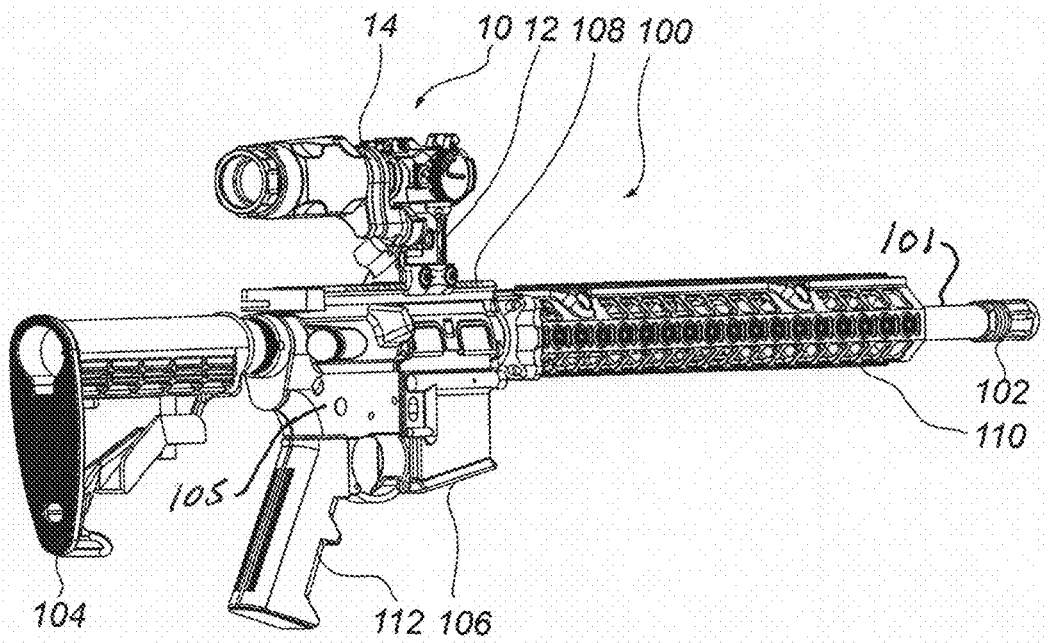
FIG. 1 shows a perspective view from a right side of a firearm with the sight and accessory mount assembly mounted thereon, with the accessory mount pivoted into a first end position.

FIG. 1 shows a perspective view from a right side of a firearm 100 with a sight and accessory mount assembly 10 attached to the firearm 100. The sight and accessory mount assembly 10 comprises a sight mount 12 and an accessory mount 14. The sight and accessory mount assembly 10 is shown with the accessory mount 14 in a first end position. In the illustrated embodiment, the firearm 100 is a rifle (and will be referred to as such below), particularly an AR-platform rifle, but this is by way of example only. The rifle 100 has a stock 104, arranged to be in contact with a shoulder of an operator (not shown) of the rifle 100 during shooting. In addition, the rifle 100, in the particular exemplary embodiment shown in the drawings, comprises a receiver 105 with a pistol grip 112 and a magazine well 106 for receiving a magazine (not shown). Arranged on an upper side of the receiver is a rail 108 configured for attaching the sight and accessory mount assembly 10. The rifle 100 further comprises a barrel 101 that may be fitted with a flash suppressor or muzzle brake 102 and/or a handguard 110 that covers at least a major portion of the barrel 101. The muzzle brake 102 (if attached) extends in the direction of a target during firing of the rifle 100.

Figure 2:
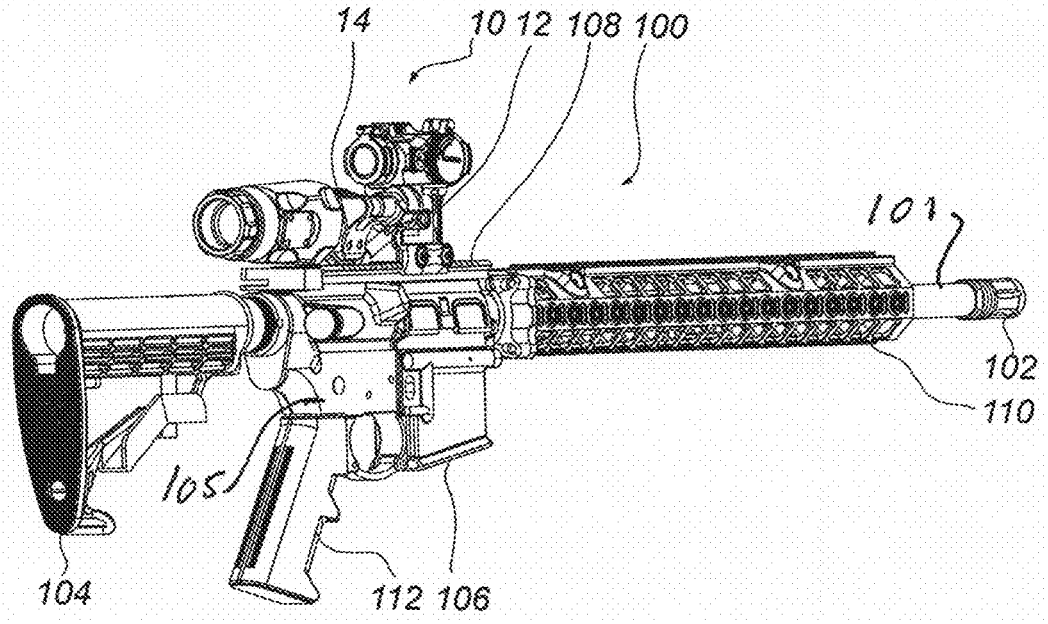
FIG. 2 shows a perspective view from the right side of a firearm with sight and accessory mount assembly mounted thereon, with the accessory mount pivoted into a second end position.

FIG. 2 shows a perspective view from the same side as in FIG. 1. In FIG. 2 the sight and accessory mount assembly 10 is pivoted into a second end position.

Figure 3A:
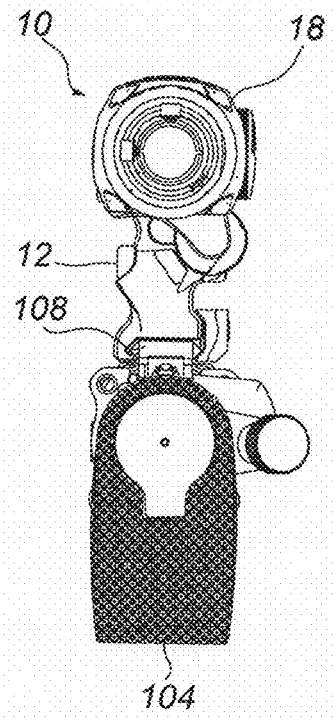
FIG. 3*a* shows a partial plan view from the rear of the rifle with the accessory mount in the first end position.
Figure 3B:
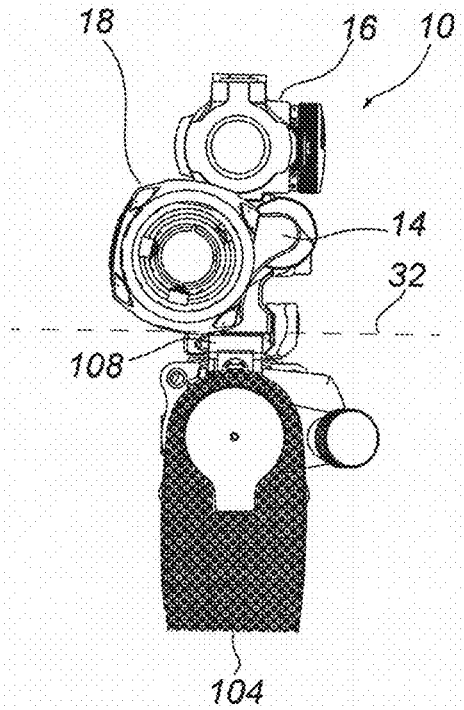
FIG. 3*b* shows a partial plan view from the rear of the rifle with the accessory mount in the second end position.

FIGS. 3*a* and 3*b* show partial plan views from the rear of the rifle 10 showing the accessory mount 14, carrying an accessory 18 in the form of magnifier or magnifying optic 18, in the first end position and the second end position. The accessory mount 14 pivots relative to the sight mount 12. FIG. 3*a* shows the accessory mount 14 and the accessory 18 pivoted to the first end position. In the first end position, the accessory 18 aligns and is collinear with a sight 16. This allows the operator to acquire a sight picture through both the sight 16 and the accessory 18 at the same time.

In FIG. 3*b* the accessory mount 14 and the accessory 18 are shown as pivoted downward toward the rail 108 of the rifle 100 to a second end position. In the second end position, the accessory mount 14 and the accessory 18 are pivoted away from the sight mount 12 and the sight 16. Thus, in the second end position, the accessory 18 is pivoted downward and sideways relative to the sight 16, so that the accessory 18 clears the sight 16 and thus does not obstruct the sight 16 or the sight picture provided by the sight 16. In the configuration shown in FIGS. 2 and 3*b*, the sight 16 can be used on its own, such as during close combat operations.

FIG. 3*b* shows the accessory 18 adjacent the rail 108 in the second end position. The sight mount 12 has a lower side 20 (FIG. 4) that contacts an upper surface of the rail 108 when the sight mount 12 is attached or mounted to the rail 108. The lower side 20 of the sight mount 12 defines a plane 32 (FIG. 3*b*). When the accessory mount 14 is in the second end position, a portion of the accessory mount 14 and the accessory 18 intersects the plane 32. Worded differently, when the accessory 18 is in the second end position, a portion of the accessory mount 14 and the accessory 18 contacts the upper surface of the rail 108. FIG. 3*b* shows that when the accessory mount 14 and the accessory 18 are in the second end position, the accessory 18 clears and does not obstruct the view through the sight 16.

Figure 4:
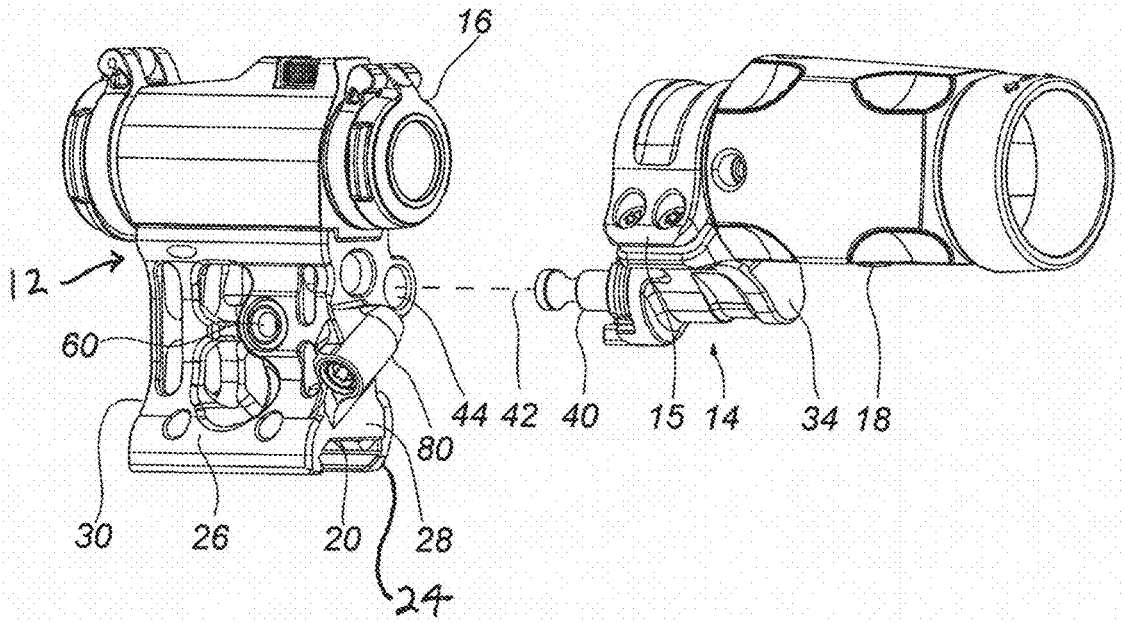
FIG. 4 shows an exploded perspective view of the sight mount and sight and the accessory mount and the accessory.

FIG. 4 shows an exploded perspective view of the sight mount 12, the sight 16, the accessory mount 14, and the accessory 18. The sight 16 (shown as a red dot sight by way of example only) is removably attached to a top or upper surface of the sight mount 12. The accessory mount 14 is arranged between the sight mount 12 and the stock 104, but the order may be reversed. The accessory mount 14 extends from a rear side 28 of the sight mount 12 in a rearward direction relative to the rifle 100. The accessory mount 14 carries or fastens an accessory 18. The accessory 18 is shown, by way of example only, in the form of a 3× magnifying optic. When the accessory mount 14 is arranged in the first end position, an optical axis of the sight 16 is aligned and collinear with the accessory 18. The operator may thereby acquire a magnified sight picture of a target with the red dot overlaid.

The accessory mount 14 comprises a body having a pivot pin or spigot 40 extending forwardly from a front side 36 of the accessory mount 14, which has a rear side 34. The pivot pin 40 has a first end 40*a* and a second end 40*b* (see FIG. 6), wherein the first end 40*a* is received in a pivot pin recess or orifice 44 at the rear of the sight mount 12, thereby enabling the accessory mount 14 to pivot, or rotate, around a pivot axis 42 (see FIG. 7*b*) relative to the sight mount 12. The accessory mount 14 has an attachment mechanism, advantageously in the form of a ring mount 15, for removably attaching or clamping the accessory 18 to the accessory mount 14.

The sight mount 12 comprises a cross bolt 60 for locking the accessory mount 14 to the sight mount 12. The cross bolt 60 is slidably supported by the sight mount 12 and is slidable between a first position and a second position. In the first position, the cross bolt 60 prevents axial movement of the pivot pin 40 of the accessory mount 14 along the pivot pin axial direction or pivot axis 42, and prevents removal of the accessory mount 14 from the sight mount 12. The cross bolt 60 will be further described below with reference to FIGS. 7*a*-7*e*.

The sight mount 12 has a lower side 20, an upper side 22 (FIG. 5), a rear or first side 28, a front or second side 30, a right or third side 24, and a left or fourth side 26. The sight mount 12 further comprises a pivot lock 80 for biasing the accessory mount 14 selectively in the first end position and the second end position. The pivot lock 80 will be further described below with reference to FIGS. 5, 6 and 7*b*. At least a portion of the upper side 22 of the sight mount 12 is configured for removably attaching the sight 16 to the sight mount, as shown in FIG. 5.

Figure 5:
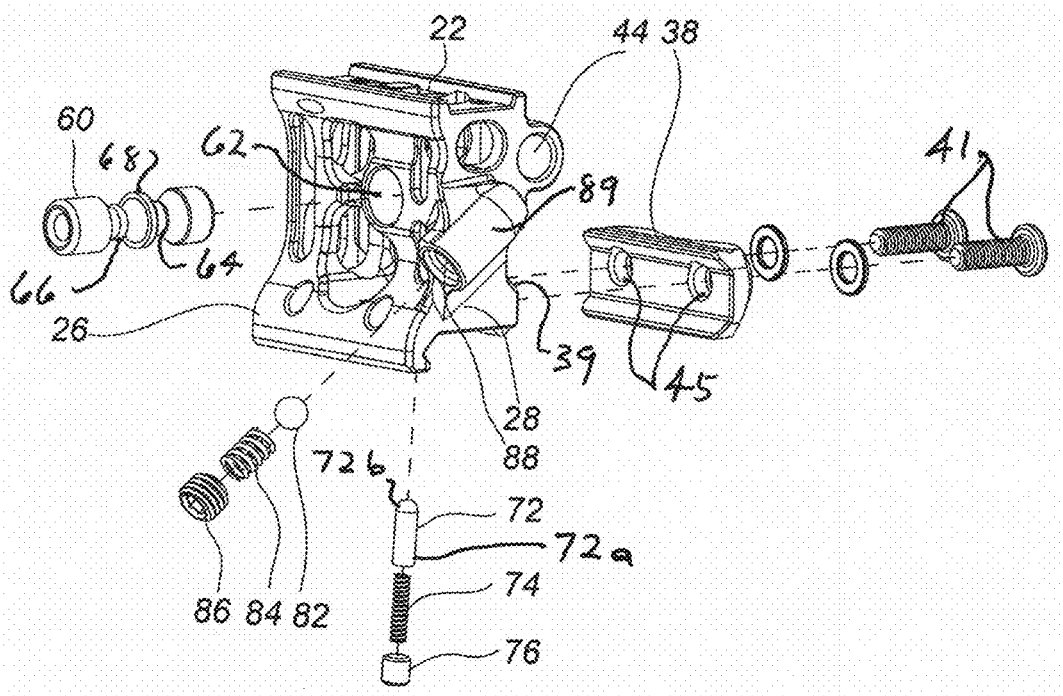
FIG. 5 shows a perspective exploded view from the left side of the sight mount.

FIG. 5 shows a perspective exploded view from the left side 26 of the sight mount 12. The sight mount 12 is shown having a clamping member 38 interacting with a ledge 39 on the right side 24 of the sight mount 12. The clamping member 38 and the ledge 39 cooperate to clamp the sight mount 12 to the rail 108 of the rifle 100. The clamping is achieved by (preferably) two fastening elements 41, shown, in the illustrated exemplary embodiment, as threaded bolts that extend through corresponding holes 45 in the clamping member 38 and then thread into threaded holes (not shown) in the sight mount 12.

The cross bolt 60 (also shown in FIGS. 7*d* and 7*e*) is slidably mounted in a through hole 62 of the sight mount 12. The cross bolt 60 has a first annular recess or groove 64 and a second annular recess or groove 66, separated by an annular ridge 68. The cross bolt 60, which is rotationally symmetric, interacts with and is engaged by a first plunger 72 comprising a cylindrical plunger shaft 72*a* terminating in a rounded inner end 72*b*. The first plunger is seated in a first plunger hole 78 in the sight mount 12 (see FIG. 7*c*), and it is biased inwardly by a first plunger spring 74, preferably a helical coil spring, seated against the plunger shaft 72*a*. The plunger hole 78 is closed off at its outer end by a first threaded plunger screw 76 (see FIGS. 5 and 7*c*). The first plunger 72 is thereby spring-loaded. The rounded inner end 72*b* of the spring-loaded first plunger 72 is selectively engageable with the first recess 64 in the first position of the cross bolt 60, and with the second recess 66 in the second position of the cross bolt 60. The spring-loaded first plunger 72, the first annular recess 64, the second annular recess 66 and the annular ridge 68 of the cross bolt 60 form a biasing mechanism for the cross bolt 60.

FIG. 5 further shows a second plunger 82 supported in a second plunger hole 88 in a tubular fitting 89 on the rear side 28 of the sight mount 12. The second plunger 82 may advantageously be formed in a spherical shape, as shown. The second plunger hole 88 is closed at its outer end by a second threaded plunger screw 86. The second plunger 82 is biased by a second helical plunger spring 84 captured between the second plunger 82 and the second threaded plunger screw 86 so as to spring-load the second plunger 82 and bias it in an inward direction.

Figure 6:
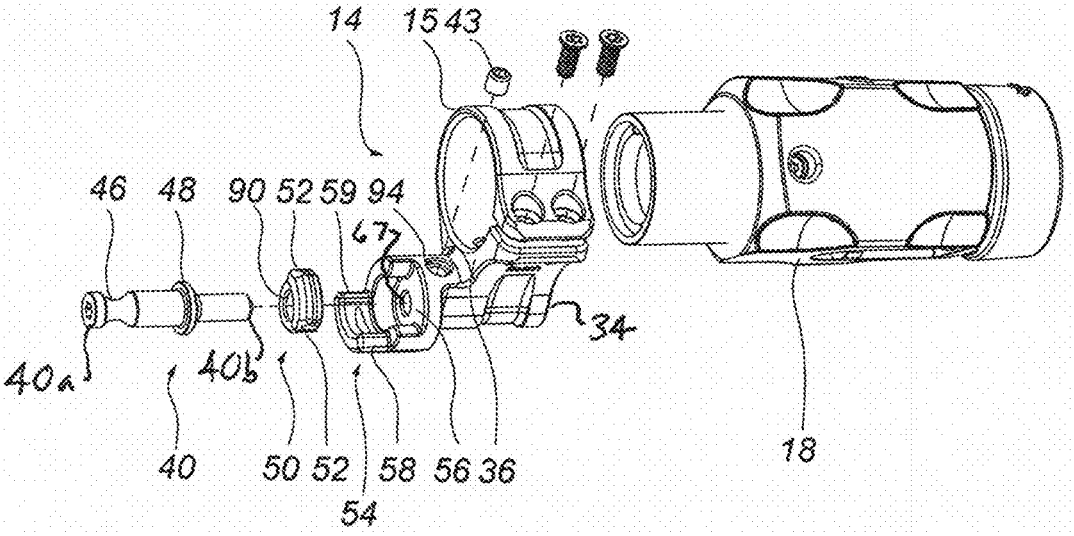
FIG. 6 shows a perspective exploded view of the accessory mount.

FIG. 6 shows a perspective exploded view of the accessory mount 14. The accessory mount 14 includes the above-mentioned pivot pin 40, which has a first end 40*a* and a second end 40*b*. Adjacent the first end 40*a* is an annular groove 46 that engages the cross bolt 60 to prevent axial movement, or movement in the pivot pin axial direction, of the accessory mount 14 relative to the sight mount 12. The second end 40*b* of the pivot pin 40 is inserted into a recess 67 in a protruding member 54 extending forwardly from the front side 36 of the accessory mount 14. Between the annular groove 46 of the pivot pin 40 and the second end 40*b* of the pivot pin 40 is an annular ridge 48. The pivot pin 40 is fixed, or securely mounted, to the accessory mount 14 by a fixation member 43, such as a bolt or screw, that threads into an opening 94 that is oriented transverse to the recess 67. The fixation member opening 94 is connected to the recess 67 such that the fixation member 43 may be threaded into the opening 94 to apply a transverse or radially inward force to the pivot pin 40.

As mentioned above, the protruding member 54, which extends from the front side 36 of the accessory mount 14 parallel with the pivot pin 40, forms or includes a wall that has a first end 58 and a second end 59, and that outlines a portion of a cylinder centered on the pivot axis around the pivot pin 40. The protruding member 54 overlaps and engages the right side 24 of the sight mount 12. The first end 58 engages the right or third side 24 of the sight mount 12 when the accessory mount 14 is in the first end position. The second end 59 engages the right or third side 24 of the sight mount 12 when the accessory mount 14 is in the second position. The first end 58 and the second end 59, together with the right or third side 24 of the sight mount 12, define the first and second pivot end positions of the accessory mount 14, as well as the range of pivot movement of the accessory mount 14.

FIG. 6 further shows an insert 50 and a seat 56, conforming to or matching the insert 50, at the front of the accessory mount 14. The insert 50 has a radially outward extending protrusion 57 (see FIG. 7*b*) with a pair of circumferentially-spaced apart indentations 52 in its outer surface. The insert 50 may have a central through hole or opening 90, configured to receive the pivot pin 40. The insert 50 forms a wall that has a first end and a second end, and it outlines a portion of a second cylinder centered on the pivot axis around which the pivot pin 40 pivots. The insert protrusion 57 matches the seat 56, and it prevents the insert 50 from rotating relative to the accessory mount 14. This results in the insert 50 moving together with the accessory mount 14 as the accessory mount 14 transitions from the first end position to the second end position. The second end 40*b* of the pivot pin 40 that is received by the recess 67 in the accessory mount 14 extends through the central opening 90 in the insert 50. The insert 50 is arranged between the annular ridge 48 of the pivot pin 40 and the seat 56. The insert 50 is thereby locked and prevented from moving in the axial direction of the pivot pin 40 when the accessory mount 14 is pivotally connected to the sight mount 12.

Figure 7A:
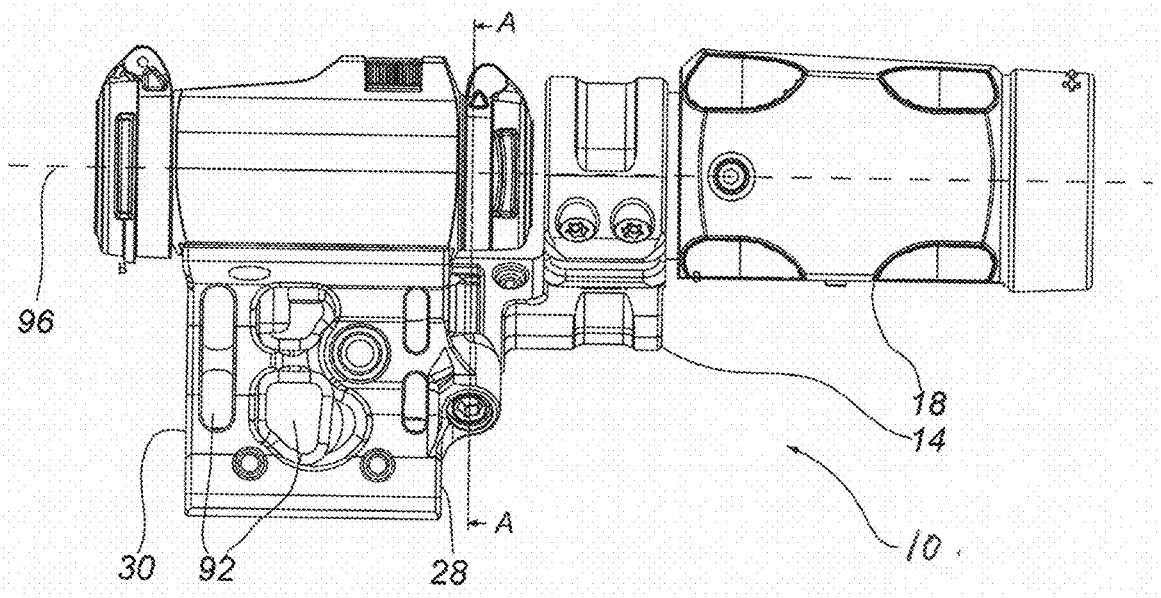
FIG. 7*a* shows a plan view of the left side of the sight mount with the accessory mount in the first end position.

FIG. 7*a* shows a plan view of the left or fourth side 26 of the sight mount 12 with the accessory mount 14 in the first end position. FIG. 7*a* shows that the sight mount 12 may have one or more weight-reducing cuts or openings 92. FIG. 7*a* shows the optical axis 96 of the sight 16 and the accessory 18, with the accessory mount 14 in the first end position, as being aligned.

Figure 7B:
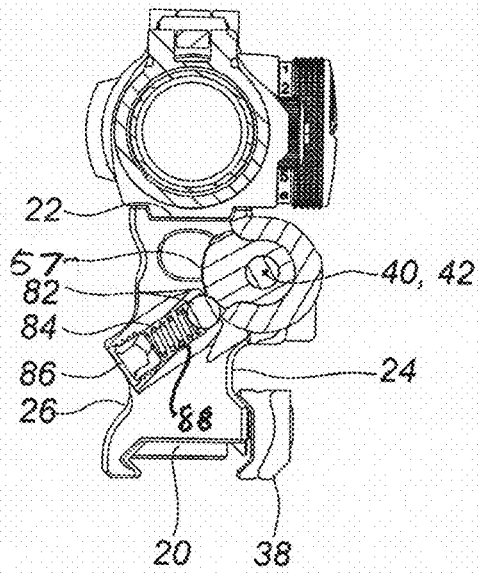
FIG. 7*b* shows a cross sectional view along line A-A in FIG. 7*a;*

FIG. 7*b* is a cross sectional view along line A-A in FIG. 7*a*, showing the spring-loaded second plunger 82. The second plunger 82 is biased against the insert 50 by the second plunger spring 84. The second plunger spring 84 and the second plunger 82 are supported within the second plunger hole 88 extending radially inward from the left or fourth side 26 towards the pivot pin 40 and the pivot axis 42. The second plunger 82 is shown as a ball or sphere, but other configurations may be functionally equivalent or suitable. The second plunger spring 84 is arranged between the threaded second plunger screw 86 that is threaded into the outer end of the second plunger hole 88 of the sight mount 12. The second plunger 82 engages the insert 50, and it is selectively engageable with the indentations 52 of the insert 50. The spring-biased second plunger 82 and the insert 50 form the above-mentioned pivot lock 80. In FIG. 7*b*, the accessory mount 14 is shown in the first end position. The pivot lock 80 biases the accessory mount 14 and prevents it from transitioning from the first end position until the spring force applied by the second plunger spring 84 through the second plunger 82 has been overcome. FIG. 7*b* further shows the pivot axis 42 around which the pivot pin 40 rotates.

Figure 7C:
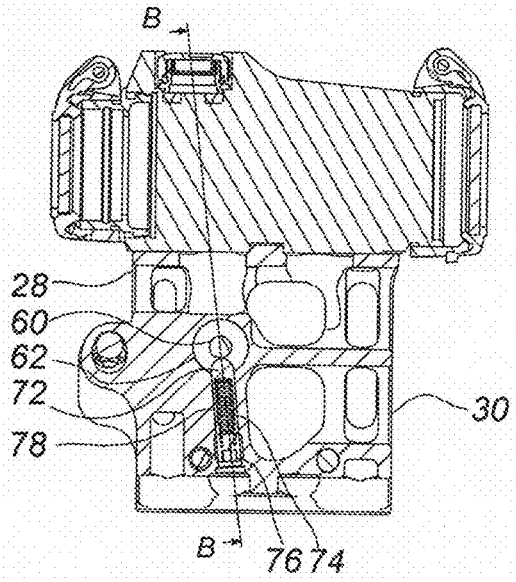
FIG. 7*c* shows a cross sectional view along a longitudinal direction, or between the front side and rear side, of the sight mount.

FIG. 7*c* is a cross sectional view along the longitudinal direction, or transverse to and extending between the front side 30 and the rear side 28 of the sight mount 12. As discussed above, the first plunger 72 is slidably supported in the first plunger hole 78. The first plunger hole 78 is closed at an outer end by a threaded first plunger screw 76, and it terminates at an inner end at the through hole 62 that slidably supports the cross bolt 60. The first plunger 72 is spring loaded by the second spring 74 that is seated between the first plunger 72 and the threaded first plunger screw 76 that is threaded into the first plunger hole 78. FIG. 7*c* shows that the first plunger hole 78 is arranged transverse to the cross bolt 60, at an angle in relation to the front side 30 of the sight mount 12. The first plunger 72 extends through the second plunger hole 78 and into the through hole 62 that slidably supports the cross bolt 60 so as to engage and bias the cross bolt 60.

Figure 7D:
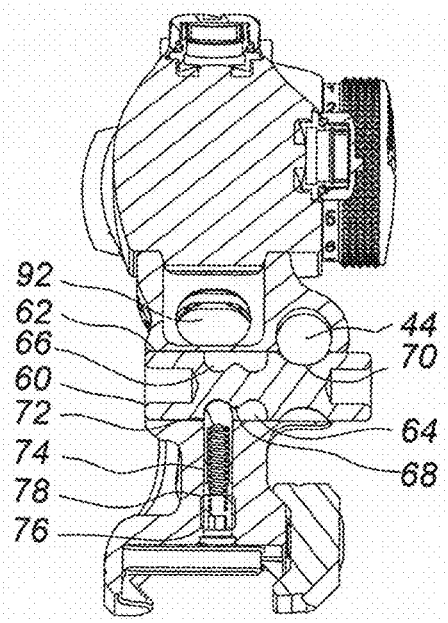
FIG. 7*d* shows a cross sectional view along line B-B in FIG. 7*c* with the cross bolt in the first position.

FIG. 7*d* shows a cross sectional view along B-B in FIG. 7*c*. The cross bolt 60 is slidably supported in the through hole 62. The through hole 62 extends from the right side 24 to the left side 26 of the sight mount 12. In FIG. 7*d*, the cross bolt 60 is arranged in a second position, in which a third cross bolt recess 70 in the cross bolt 60 is aligned with the pivot pin recess 44 that receives the pivot pin 40. The third cross bolt recess 70 is shown in the form of an annular recess or groove that conforms to the shape of the pivot pin recess 44 that receives the pivot pin 40. By conforming to the shape of the pivot pin recess 44 that receives the pivot pin 40, the third cross bolt recess 70, when aligned with the pivot pin recess 44, defines with the pivot pin recess 44 a cylindrical opening that allows the accessory mount 14 to be removed by sliding the pivot pin 40 from the sight mount 12 in the pivot pin 40 axial direction, i.e., along the pivot pin axis 42.

Figure 7E:
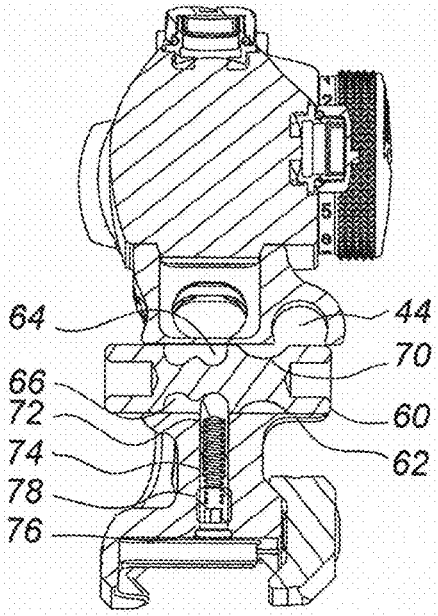
FIG. 7*e* shows a cross sectional view along line B-B in FIG. 7*c* with the cross bolt in the second position.

FIG. 7*e* shows the cross bolt 60 in a first position, wherein the third recess 70 of the cross bolt 60 engages the annular groove 46 of the pivot pin 40, and it thus prevents or blocks the pivot pin 40 from moving in the pivot pin axial direction. The accessory mount 14 is thereby prevented from being removed from the sight mount 12 when the cross bolt 60 is in the first position.

Figure 8A:
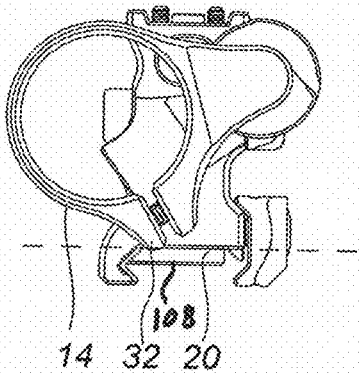
FIG. 8*a* shows a view of the rear side of the sight and accessory mount assembly.

FIG. 8*a* shows a view from the rear of the sight and accessory mount assembly 10, with the sight 16 and the accessory 18 removed. FIG. 8*a* shows that the lower side 20 of the sight mount 12 defines the plane 32. When the sight mount 12 is attached to the rail 108, the upper surface of the rail will be located at the plane 32. FIG. 8*a* further shows the accessory mount 14 pivoted to the second end position, wherein a portion of the accessory mount 14 intersects the plane 32. That portion of the accessory mount 14 will thereby contact the rail 108 when the accessory mount 14 is pivoted to the second end position.

Figure 8B:
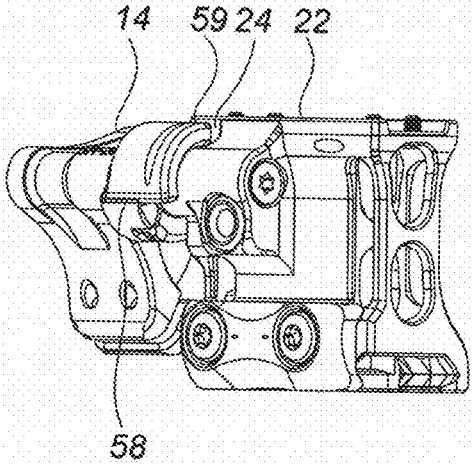
FIG. 8*b* shows a perspective view of the right side of the sight and accessory mount assembly.

FIG. 8*b* shows a perspective view of the right side 24 of the sight and accessory mount assembly 10. The protruding member 54 extending from the front side 36 of the accessory mount 14 overlaps a portion of the right side 24 of the sight mount 12. When the accessory mount 14 is in the second end position, the second wall end 59 of the protruding member 54 will contact and engage the right side 24 of the sight mount 12 and limit further pivoting of the accessory mount 14. FIG. 8*b* shows that the first wall end 58 is not in contact with the right side 24 when the accessory mount 14 is in the second end position.

Figure 8C:
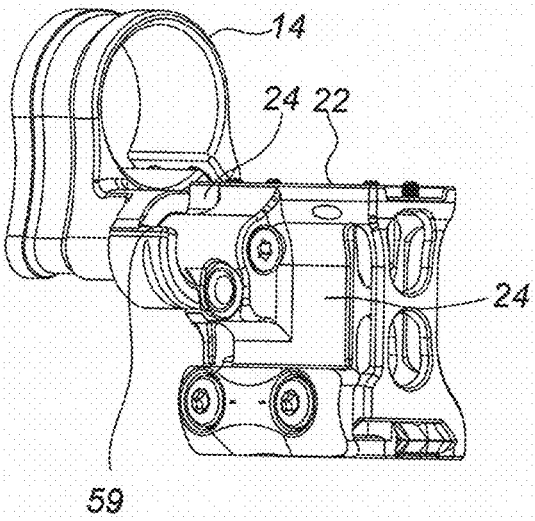
FIG. 8*c* shows the sight and accessory mount assembly with the second sight mount in the first end position.

FIG. 8*c* shows the sight and accessory mount assembly 10 of FIG. 8*b*, wherein the accessory mount 14 is in the first end position, in which the first end 58 is in contact with the right side 24 of the sight mount 12.

Figure 9:
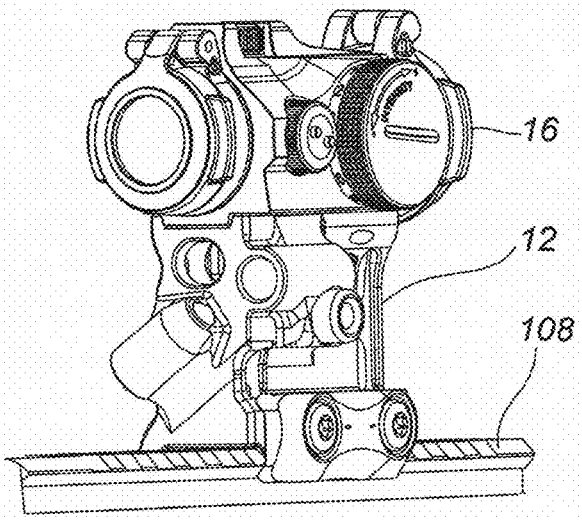
FIG. 9 shows an enlarged perspective view of the right side of the sight mount assembly, carrying a sight, attached to a rail of the rifle.

FIG. 9 shows an enlarged perspective view of the right side 24 of the sight mount 12 attached to the rail 108 of the rifle 100 and carrying, or fastening, the sight 16. With the accessory mount 14 removed from the sight and accessory mount 10, the sight mount 12 is usable on its own.

ITEM LIST

16 sight
18 accessory
20 lower side of sight mount
22 upper side of sight mount
24 right side, or third side, of sight mount
26 left side, or fourth side, of sight mount
28 rear side, or first side, of the sight mount
30 front side, or second side, of the sight mount
32 lower side plane of sight mount
34 rear side of accessory mount
36 front side of accessory mount
38 sight rail clamp
39 sight mount clamping ledge
40 pivot pin, or spigot
40*a* first end of pivot pin
40*b* second end of pivot pin
41 clamp fastening elements
42 pivot axis
43 fixation bolt
44 pivot pin recess or orifice
45 clamp apertures for fastening elements 41
46 pivot pin annular groove
48 pivot pin ridge
50 insert
52 indentations in insert
54 protruding member
56 seat for insert
57 insert protrusion
58 first wall end of insert protrusion
59 second wall end of insert protrusion
60 cross bolt
62 cross bolt support through hole
64 cross bolt first annular recess

66 cross bolt second annular recess
67 pivot pin bearing recess
68 cross bolt ridge
70 cross bolt third annular recess
72 first plunger
72*a* shaft or body of first plunger
72*b* head of first plunger
74 first plunger spring
76 fixing bolt
78 first plunger support recess
80 pivot lock
82 second plunger
84 second plunger spring
86 fixing bolt
88 second plunger support hole or recess
89 tubular fixture for second plunger
90 insert through hole or opening
92 weight-reducing cuts
94 fixation bolt opening
96 optical axis of sight and accessory in first position
100 firearm or rifle
101 barrel
102 muzzle brake
104 stock
105 receiver
106 magazine well
108 rail
110 hand guard
112 pistol grip

What is claimed is:

1. A sight and accessory mount assembly for a firearm having a rail, the sight and accessory mount assembly comprising:

a sight mount configured to carry a sight in a fixed position relative to the rail, and to be attached to the rail with the sight mount positioned at least partly between the sight and the firearm; and an accessory mount configured to carry a firearm accessory, wherein the accessory mount is pivotably connected to the sight mount, and wherein the accessory mount protrudes from the sight mount in a direction aligned with the firearm, wherein the accessory mount is pivotable between a first end position and a second end position relative to the sight, and wherein in the first end position the firearm accessory is aligned with the sight, and in the second end position the firearm accessory is pivoted away from the sight;

wherein the sight mount has a rear side and an opposite front side, and wherein the accessory mount extends from one of the rear side and the front side.

2. The sight and accessory mount assembly of claim 1, wherein the sight mount has a lower side, and in the second end position, at least a portion of the accessory mount is pivoted to intersect a plane defined by the lower side of the sight mount.

3. The sight and accessory mount assembly of claim 1, wherein in the second end position, a portion of the accessory mount is located at the rail of the firearm.

4. The sight and accessory mount assembly of claim 1, wherein in the second end position the accessory mount contacts the rail of the firearm.

5. The sight and accessory mount assembly of claim 1, wherein the sight mount has a right side and a left side, wherein the accessory mount pivots around a pivot axis located at one of the right side and the left side.

6. The sight and accessory mount assembly of claim 5, wherein a front side of the accessory mount forms a protruding member that protrudes forward from the front side along the pivot axis and that overlaps a portion of the right side of the sight mount, and wherein the protruding member engages the right side of the sight mount in the first end position and second end position.

7. The sight and accessory mount assembly of claim 6, wherein the protruding member forms a wall that has a first wall end and a second wall end and outlines a portion of a cylinder centered on the pivot axis, wherein the first wall end engages the right side of the sight mount in the first position of the accessory mount and the second wall end engages the right side of the sight mount in the second position of the accessory mount.

8. The sight and accessory mount assembly of claim 5, wherein the protruding member is arranged to provide a defined range of rotation of the accessory mount relative to the sight mount around the pivot axis.

9. The sight and accessory mount assembly of claim 8, wherein the defined range of rotation is 30-180 degrees.

10. The sight and accessory mount assembly of claim 1, wherein the accessory mount comprises a pivot pin seated in a pivot pin recess, wherein the pivot pin pivotally connects the accessory mount to the sight mount.

11. The sight and accessory mount assembly of claim 10, further comprising:

a cross bolt slidably supported by the sight mount, wherein the cross bolt has a first position and a second position, wherein in the first position the cross bolt engages the pivot pin and prevents the pivot pin from moving in an axial direction along a pivot axis, and wherein in the second position the cross bolt is disengaged from the pivot pin and allows the pivot pin to move in the axial direction along the pivot axis.

12. The sight and accessory mount assembly of claim 11, wherein the sight mount comprises a spring-loaded first plunger that engages a first cross bolt recess in the first position of the cross bolt and a second cross bolt recess in the second position of the cross bolt.

13. The sight and accessory mount assembly of claim 6, wherein the accessory mount further comprises:

an insert in the protruding member and having a pair of circumferentially spaced-apart indentations; and a pivot lock that comprises a spring loaded second plunger that is engageable with at least one of the indentations to bias the accessory mount toward the first end position.

14. The sight and accessory mount assembly of claim 1, wherein the accessory mount extends from the rear side of the sight mount, wherein the accessory mount has a rear side and an opposite front side, and wherein the front side of the accessory mount faces the rear side of the sight mount.

15. The sight and accessory mount assembly of claim 1, wherein the accessory mount defines an overhang over the firearm relative to the sight mount.

16. The sight and accessory mount assembly of claim 1, wherein the accessory mount defines an overhang over the rail of the firearm relative to the sight mount.

17. The sight and accessory mount assembly of claim 1, wherein the sight mount is a monolithic structure.

18. A sight and accessory mount assembly for a firearm having a rail, the sight and accessory mount assembly comprising:

a sight mount configured to carry a sight in a fixed position relative to the rail, and to be attached to the rail with the sight mount positioned at least partly between the sight and the firearm; and an accessory mount configured to carry a firearm accessory, wherein the accessory mount is pivotably connected to the sight mount, and wherein the accessory mount protrudes from the sight mount in a direction aligned with the firearm, wherein the accessory mount is pivotable between a first end position and a second end position relative to the sight, wherein in the first end position the firearm accessory is aligned with the sight, and in the second end position the firearm accessory is pivoted away from the sight, and wherein in the second end position, a portion of the accessory mount is located at the rail of the firearm.

19. A sight and accessory mount assembly for a firearm having a rail, the sight and accessory mount assembly comprising:

a sight mount configured to carry a sight in a fixed position relative to the rail, and to be attached to the rail with the sight mount positioned at least partly between the sight and the firearm; and an accessory mount configured to carry a firearm accessory, wherein the accessory mount is pivotably connected to the sight mount, and wherein the accessory mount protrudes from the sight mount in a direction aligned with the firearm, wherein the accessory mount is pivotable between a first end position and a second end position relative to the sight, wherein in the first end position the firearm accessory is aligned with the sight, and in the second end position the firearm accessory is pivoted away from the sight, and wherein in the second end position the accessory mount contacts the rail of the firearm.

20. A sight and accessory mount assembly for a firearm having a rail, the sight and accessory mount assembly comprising:

a sight mount configured to carry a sight in a fixed position relative to the rail, and to be attached to the rail with the sight mount positioned at least partly between the sight and the firearm, wherein the sight mount is a monolithic structure; and an accessory mount configured to carry a firearm accessory, wherein the accessory mount is pivotably connected to the sight mount, and wherein the accessory mount protrudes from the sight mount in a direction aligned with the firearm, wherein the accessory mount is pivotable between a first end position and a second end position relative to the sight, and wherein in the first end position the firearm accessory is aligned with the sight, and in the second end position the firearm accessory is pivoted away from the sight.

* * * * *